US006413414B1

(12) United States Patent
Arnold et al.

(10) Patent No.: US 6,413,414 B1
(45) Date of Patent: Jul. 2, 2002

(54) PROCESS FOR SEPARATION OF DEWAXED LUBE OIL INTO LIGHT AND HEAVY PRODUCTS

(75) Inventors: Victor E. Arnold, Sugar Land; Richard T. Cleveland, Missouri City, both of TX (US)

(73) Assignee: Bechtel Corporation, Houston, TX (US)

( * ) Notice: Subject to any disclaimer, the term of this patent is extended or adjusted under 35 U.S.C. 154(b) by 0 days.

(21) Appl. No.: 09/565,676

(22) Filed: May 4, 2000

Related U.S. Application Data

(60) Provisional application No. 60/132,542, filed on May 5, 1999.

(51) Int. Cl.[7] ..... C10G 73/02; C10G 3/34; C10G 3/10; C10G 31/06

(52) U.S. Cl. ..... 208/308; 208/30; 208/362; 208/366

(58) Field of Search ..... 208/30, 308, 362, 208/366

(56) References Cited

U.S. PATENT DOCUMENTS 4,199,433 A * 4/1980 Button et al. ..... 208/31
4,419,227 A * 12/1983 Sherman ..... 208/321
5,006,222 A * 4/1991 Sequeira, Jr. ..... 208/187
5,100,536 A * 3/1992 Bonisch et al. ..... 203/49
5,256,258 A * 10/1993 Seifert et al. ..... 203/49

* cited by examiner

*Primary Examiner*—Walter D. Griffin
*Assistant Examiner*—Tam M Nguyen
(74) *Attorney, Agent, or Firm*—Madan, Mossman & Sriram, P.C.

(57) ABSTRACT

Methods and apparatus to separate a light lube stock product and a heavy lube stock product from heavy dewaxed lube oils are described which maintain product specifications while utilizing conventional refinery equipment. The heavy dewaxed lube oil stream is first heated, such as in a spiral heat exchanger in the top of a vacuum stripper, with the heavy lube stock fraction, and/or with hot oil. Next, the heated heavy dewaxed lube oil stream is injected into the vacuum stripper, and fuel gas is injected at the bottom of the stripper as the stripping medium. A light lube stock fraction is removed from the upper portion of the stripper, and a heavy lube stock fraction is removed from the lower portion thereof. Optionally, the gas stripping medium is removed from the top of the stripper by a vacuum pump and used to fuel a hot oil exchanger to heat the oil which in turn is employed to heat the heavy dewaxed lube oil stream.

18 Claims, 2 Drawing Sheets

PROCESS FOR SEPARATION OF DEWAXED LUBE OIL INTO LIGHT AND HEAVY PRODUCTS

This application claims the benefit of U.S. Provisional Application No. 60/132,542 filed May 5, 1999.

FIELD OF THE INVENTION

The present invention relates to systems and methods for recovering and separating lube oils, and in a further embodiment relates to methods and apparatus for separating heavy dewaxed lube oils, especially bright stock into light and heavy products.

BACKGROUND OF THE INVENTION

Manufacturing methods for separating heavy lube base oil products, including bright stock, into salable, higher value, higher quality light and heavy products are known. The use of direct fired heat to heat the material to the necessary temperatures to be treated and separated has the possibility of hot spots in the heater tubes which risks undesirable product degradation. The use of steam to strip the oil requires an additional drying treatment to insure the final product remains as dry as the feed stream, an unattractive process complication. The use of steam ejectors as motive energy for producing the vacuum will require additional waste treatment, which is preferably avoided. The use of flash separation requires operation at vacuums below those felt to be within prediction method ranges. Modification of upstream processing facilities to produce light and heavy bright stock products is possible. However, this will usually require additional tankage, more severe processing conditions, and higher capital and operating costs.

It is desirable for a process to be provided which separates heavy dewaxed lube oil without these process complications, but without any decrease in product quality.

SUMMARY OF THE INVENTION

Accordingly, it is an object of the present invention to provide a process and system for separating heavy dewaxed lube oil which can use equipment familiar to the refining industry.

It is additionally an object of the present invention to provide a process and system for separation of heavy dewaxed lube oil, including bright stock, which avoids product degradation.

It is further an object of the invention to provide a process for separating heavy dewaxed lube oil which does not require additional drying treatments.

Another object of the invention is to provide a process and system for heavy dewaxed lube oil separation which does not require additional waste treatment, and which operates in a parameter range where prediction methods and modeling may be used.

In carrying out these and other objects of the invention, there is provided, in one form, a process for separating heavy dewaxed lube oils, including heating a heavy dewaxed lube oil stream; injecting the heated heavy dewaxed lube oil stream into a vacuum stripper; injecting a gas stripping medium at the bottom of the stripper; removing a light lube oil fraction from an upper portion of the stripper; and removing a heavy lube oil fraction from the bottom of the stripper.

Figure 1:
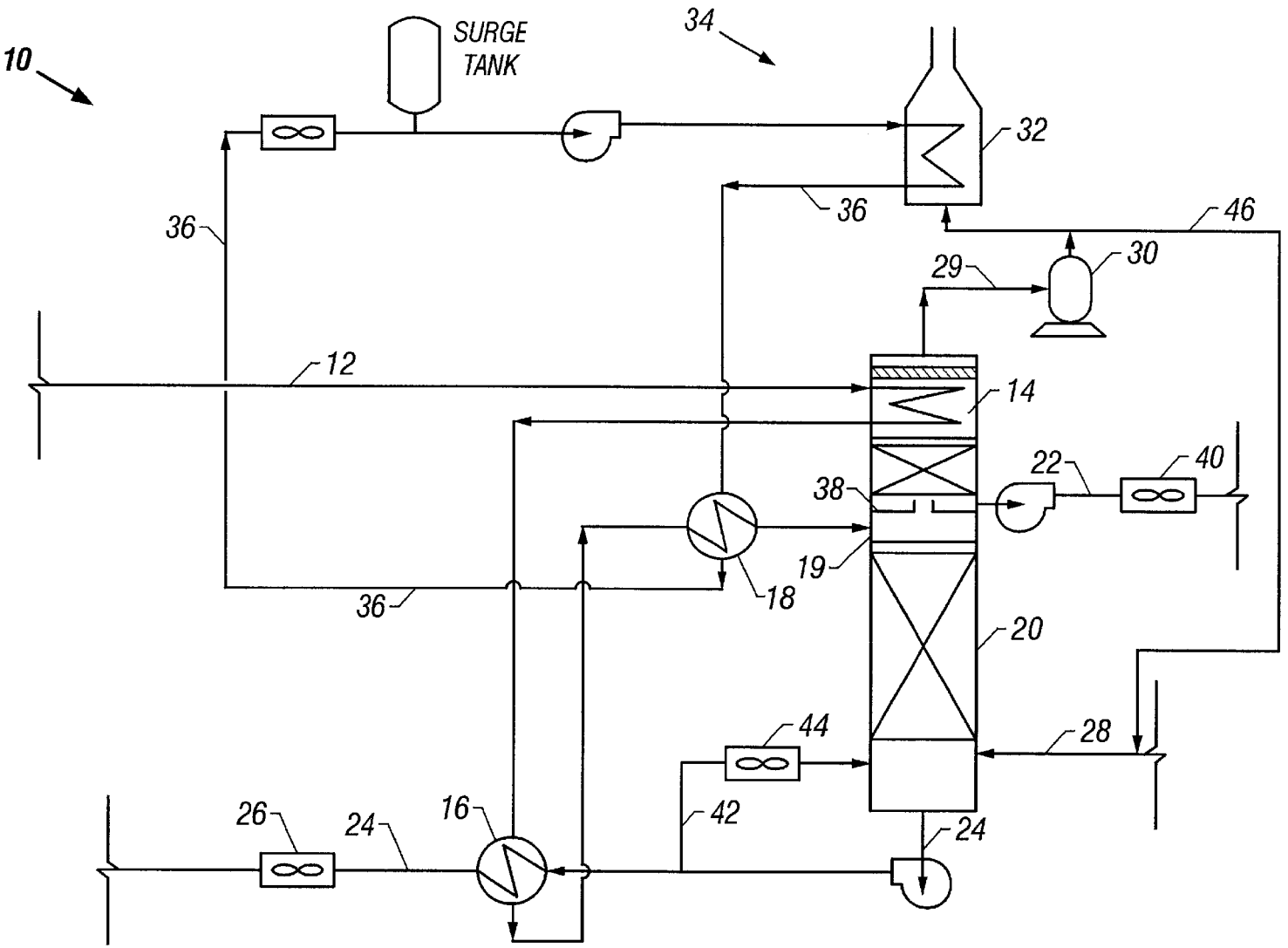
FIG. 1 is a schematic representation of the inventive process for separating dewaxed lube oil, including bright stock, into a light and heavy fraction.

It will be appreciated that FIG. 1 is not to scale or proportion as it is simply a schematic for illustration purposes.

DETAILED DESCRIPTION OF THE INVENTION

For the purposes of this description, bright stock dewaxed lube oil is used as the feedstock in a non-limiting example. It will be appreciated that the inventive process can be advantageously used on other feedstocks, indeed any dewaxed lube oil and is not restricted to bright stock dewaxed lube oil. Further it will be appreciated that the terms "heavy" and "light" are well known and used in this industry with meanings known to those skilled in the art. They are not indefinite terms, but rather establish the relative boiling points of various streams.

The inventive design solves a number of the critical design objectives in a relatively simple approach, utilizing equipment familiar to the refining industry. The use of a hot oil system eliminates the concern over "hot spots" in a direct fired heater that would reduce product quality, such as increased product color and/or reduced stability, etc. The use of fuel gas as the stripping medium eliminates the potential for contact of the products with water and thereby the need for additional drying of the products. The use of a vacuum pump rather than steam ejectors reduces the waste water treatment load and allows the overhead gas from the vacuum pump to be fuel for the hot oil heater. The use of a stripping tower, with a rectification section to condense the light product allows the separation to take place at a higher pressure than if a simple flash tower is used. This moves the physical property and vapor-liquid estimation (VLE) into a region often seen in refinery fuels-type vacuum towers and provides confidence in the prediction methods. The use of a spiral heat exchanger in the overhead of the tower condenses the light product and provides reflux for product quality improvement as well as a very low pressure drop across the condensing system.

Shown in FIG. 1 is a simplified block flow diagram illustrating a bright stock dewaxed lube oil separation system 10 using a dewaxed product (DWO) bright stock 12 from either directly off an existing product vacuum drying tower (hot) or from tankage (cold) being first sent through a spiral heat exchanger 14 in the top of the stripping tower 20 to condense the light bright stock product 22 and provide reflux for product rectification and purification. The use of a rectified stripper allows a sharp separation between the two products. The use of a falling film evaporator or similar equipment gives only a single stage flash and thereby very poor separation between the products. Additional pre-heat to the feed stream 12 is provided by a feed vs. vacuum stripper bottoms product 24 exchanger 16. The final temperature needed to achieve the necessary rate of stripping is accomplished in a feed vs. hot oil exchanger 18, prior to injection of the feed 12 into the vacuum stripper 20 at feed point 19.

Figure 2:
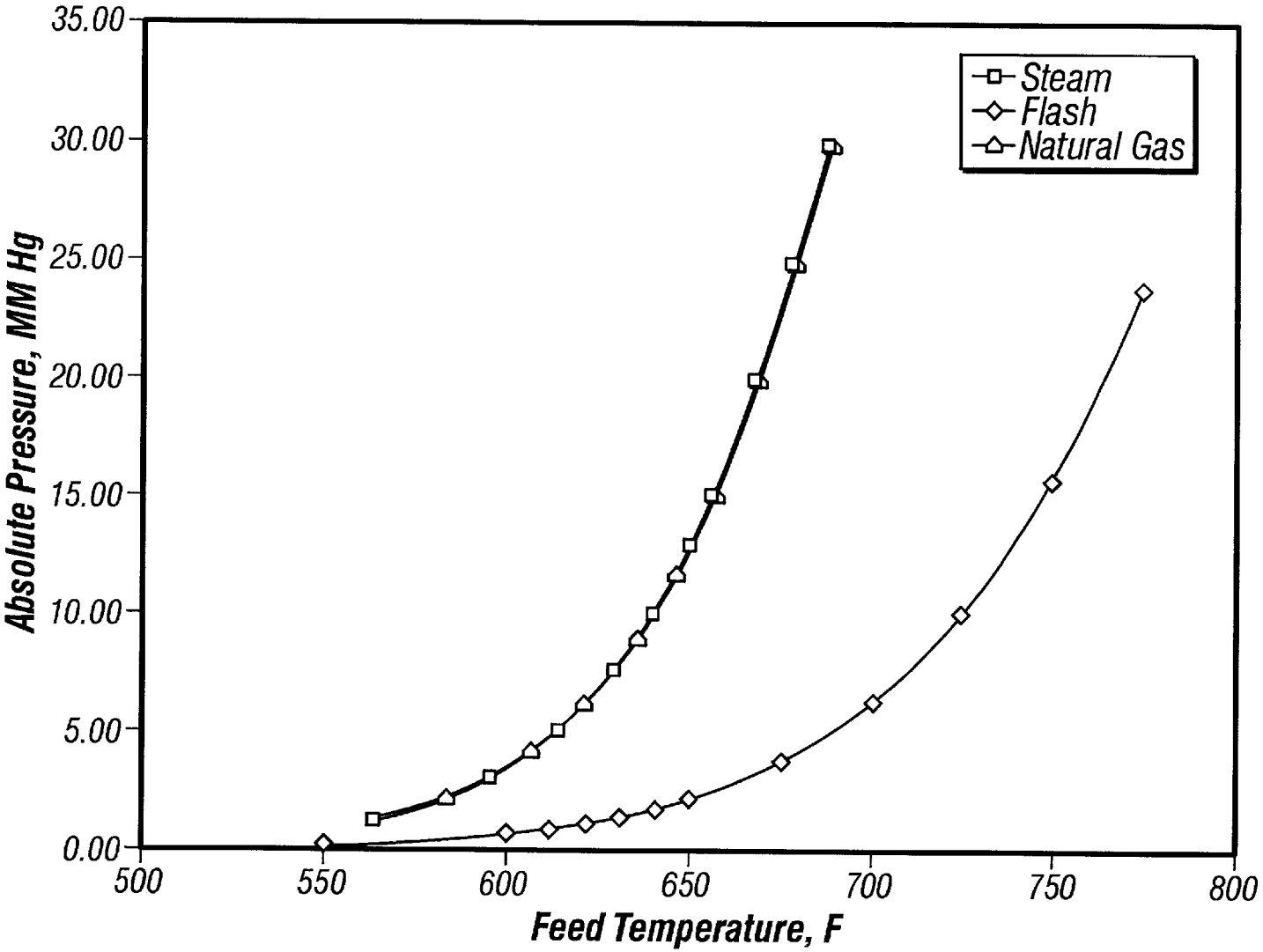
FIG. 2 is a chart of temperature/pressure curves needed to lift 20% of a bright stock feed.

A plot of the feed temperatures and tower pressures is given in FIG. 2 for 20% lift of light bright stock product from a typical bright stock feed. FIG. 2 illustrates the relative pressures needed for a simple flash separation and a stripping system utilizing steam or natural gas. Based on a maximum feed temperature of 650° F. (343° C.), considered below the temperature required to cause product degradation, the pressure in the natural gas stripper 20 is approximately 13 mm Hg absolute (1.73 kPa; well within the normal design conditions for fuels-type vacuum towers). This value far exceeds the 2.5 mm Hg (0.3 kPa) pressure needed if a simple flash system was used and the same pressure needed if steam is used as the stripping medium. However, the use of steam will require an additional drying step to insure the final products are within specification. Operation above 10 mm Hg (1.3 kPa) provides a design that is within normal design conditions for refinery applications.

The bottom bright stock (BS) product 24 is pumped through the feed v. bottom product exchanger 16 and a final product air cooler 26 to insure the material is sufficiently cool to safely send to tankage. Fuel gas 28 used as the stripping medium exits the tower 20 at the top and is sent via stream 29 to the vacuum pump 30 where it is pumped to a pressure sufficient for use as fuel in the hot oil heater 32. Other gas stripping media include, but are not necessarily limited to, natural gas, nitrogen, or other inert gas.

The hot oil sub-system 34 is a conventional liquid system utilizing a heat transfer fluid, for example THERMINOL 75 (available from Monsanto) or SYLTHERM 800 (available from Dow Chemical) in loop 36. Other suitable heat transfer fluids may be used. The stripping tower 20 internal design includes structured packing to maximize efficiency of both mass and heat transfer at the minimum pressure loss within the tower. A light bright stockdraw tray 38 above the feed point 19 collects the light BS product 22 for pumping through a final product air cooler 40 to insure the material is sufficiently cool to safely send to tankage. The light bright stock fraction 22 is removed from an upper portion of the vacuum stripper 20, which is defined as the top half of stripper 20. The lower portion is the lower half of stripper 20. The system is designed to handle a wide range of feed rates and feed temperatures. For instance, an expected broad feed temperature range is from about 160 to about 400° F. (about 71 to about 204° C.), depending upon the feed source.

Mass balances for two different feed rates are shown in Table I, as non-limiting Examples:

TABLE I

Feed and Product Rates Barrels/Day ($m^3$/day)

| Ex. | DWO Bright Stock Feed | | Heavy BS Fraction | | Light BS Fraction | |
|---|---|---|---|---|---|---|
| 1 | 7200 | (1143) | 5760 | (916) | 1440 | (227) |
| 2 | 3600 | (572) | 2880 | (458) | 720 | (114) |

Optional features of the invention include, but are not necessarily limited to, quench stream 42 from vacuum stripper bottoms products 24 thorough air cooler 44 to the bottom portion of the vacuum stripper 20. Further, if hot oil heater 32 does not require all of the stripping medium (fuel gas) in stream 29 from the top of stripper 20, a portion may be recycled as make up stream 46 to stripping medium stream 28.

In the foregoing specification, the invention has been described with reference to specific embodiments thereof, and has been demonstrated as effective in providing designs and methods for the separation of heavy dewaxed lube oils into a light component and a heavy component using conventional equipment. However, it will be evident that various modifications and changes can be made thereto without departing from the broader spirit or scope of the invention as set forth in the appended claims. Accordingly, the specification is to be regarded in an illustrative rather than a restrictive sense. For example, there may be other ways of configuring and/or operating the processing scheme of the invention differently from those explicitly described herein which nevertheless fall within the scope of the claims. It is anticipated that by routing certain streams differently, or by adjusting operating parameters certain optimizations and efficiencies may be obtained which would nevertheless not cause the system to fall outside of the scope of the appended claims.

We claim:

1. A process for separating heavy dewaxed lube oils, comprising:

a) heating a heavy dewaxed lube oil stream;

b) injecting the heated heavy dewaxed lube oil stream into a vacuum stripper at a feed point;

c) injecting a gas stripping medium at a lower portion of the vacuum stripper;

d) removing a light lube stock fraction from an upper portion of the vacuum stripper; and e) removing a heavy lube stock fraction from a lower portion of the vacuum stripper.

2. The process of claim 1 where the gas stripping medium is fuel gas.

3. The process of claim 1 further comprising:

f) removing the gas stripping medium from the top of the stripper by a vacuum pump; and g) using at least a portion of the removed gas stripping medium to fuel a fired heater that heats oil to heat the heavy dewaxed lube oil stream.

4. The process of claim 1 further comprising:

h) condensing the light lube stock fraction by heating the heavy dewaxed lube oil stream in a spiral heat exchanger in the top of the vacuum stripper.

5. The process of claim 1 further comprising:

i) heating the heavy dewaxed lube oil stream with the heavy lube stock fraction.

6. The process of claim 1 further comprising:

j) heating the heavy dewaxed lube stock stream with hot oil.

7. The process of claim 1 where the vacuum stripper is operated at a temperature of 650° F. (343° C.) or less.

8. The process of claim 1 where the vacuum stripper is operated at a pressure of 10 mm Hg (1.3 kPa) or above.

9. The process of claim 1 where the light lube stock fraction is removed from the vacuum stripper above the feed point.

10. A process for separating heavy dewaxed lube oils, comprising:

a) heating a heavy dewaxed lube oil stream;

b) injecting the heated heavy dewaxed lube oil stream into a vacuum stripper at a feed point;

c) injecting a gas stripping medium at a lower portion of the vacuum stripper;

d) operating the vacuum stripper at a temperature of 650° F. (343° C.) or less and at a pressure of 10 mm Hg (1.3 kPa) or above;

e) removing a light lube stock fraction from an upper portion of the vacuum stripper; and f) removing a heavy lube stock fraction from a lower portion of the vacuum stripper.

11. The process of claim 10 where the gas stripping medium is fuel gas.

12. The process of claim 10 further comprising:

f) removing the gas stripping medium from the top of the stripper by a vacuum pump; and g) using at least a portion of the removed gas stripping medium to fuel a fired heater that heats oil to heat the heavy dewaxed lube oil stream.

13. The process of claim 10 further comprising:

h) condensing the light lube stock fraction by heating the heavy dewaxed lube oil stream in a spiral heat exchanger in the top of the vacuum stripper.

14. The process of claim 10 further comprising:

i) heating the heavy dewaxed lube oil stream with the heavy lube stock fraction.

15. The process of claim 10 further comprising:

j) heating the heavy dewaxed lube oil stream with hot oil.

16. The process of claim 10 where the light lube stock fraction is removed from the vacuum stripper above the feed point.

17. The process of claim 10 where the heavy dewaxed lube oil stream is a dewaxed bright stock stream, the light lube stock fraction is a light bright stock fraction, and the heavy lube stock fraction is a heavy bright stock fraction.

18. A process for separating heavy dewaxed lube oils, comprising:

a) heating a dewaxed bright stock stream:
   1) in a spiral heat exchanger in the top of the vacuum stripper;
   2) with a heavy bright stock fraction; and
   3) with hot oil;

b) injecting the heated dewaxed bright stock stream into a vacuum stripper at a feed point;

c) injecting fuel gas at a lower portion of the stripper as the stripping medium;

d) operating the vacuum stripper operated at a temperature of 650° F. (343° C.) or less and at a pressure of 10 mm Hg (1.3 kPa) or above;

e) removing a light bright stock fraction from an upper portion of the vacuum stripper above the feed point;

f) removing a heavy bright stock fraction from a lower portion of the vacuum stripper;

g) removing the gas stripping medium from the top of the vacuum stripper by a vacuum pump;

h) using at least a portion of the removed gas stripping medium to fuel a fired heater that heats the oil to heat the dewaxed bright stock stream; and i) condensing the light bright stock fraction by heating the dewaxed bright stock stream with the light bright stock fraction in the spiral heat exchanger.

* * * * *